United States Patent [19]

Lapraik et al.

[11] Patent Number: 4,553,804

[45] Date of Patent: Nov. 19, 1985

[54] ELECTRICAL CONNECTOR

[75] Inventors: Scott J. Lapraik, Pleasantville; Wayne A. Becker, Meadville, both of Pa.

[73] Assignee: GTE Products Corporation, Stamford, Conn.

[21] Appl. No.: 607,841

[22] Filed: May 7, 1984

[51] Int. Cl.[4] ..... H01R 13/629

[52] U.S. Cl. ..... 339/74 R; 339/75 MP; 339/176 MP

[58] Field of Search ..... 339/74 R, 75 MP, 176 MP

[56] References Cited

U.S. PATENT DOCUMENTS

| | | | |
|---|---|---|---|
| 3,697,929 | 10/1972 | Konewko et al. | 339/75 MP |
| 3,899,234 | 8/1975 | Yeager et al. | 339/74 R |
| 4,021,091 | 5/1977 | Anhalt et al. | 339/176 MP |
| 4,169,644 | 10/1979 | Bonhomme | 339/75 MP |
| 4,179,177 | 12/1979 | Lapraik | 339/74 R |
| 4,196,955 | 4/1980 | Anhalt | 339/74 R |
| 4,303,294 | 12/1981 | Hamsher, Jr. et al. | 339/74 R |

FOREIGN PATENT DOCUMENTS

| | | | |
|---|---|---|---|
| 35354 | 9/1981 | European Pat. Off. | 339/74 R |

*Primary Examiner*—John McQuade

*Attorney, Agent, or Firm*—Robert E. Walter; William H. McNeill

[57] ABSTRACT

A zero or low insertion force connector having a cam for moving an inner housing relative to an outer housing wherein the respective housings each include cam engaging surfaces which provide positive engagement with the cam during both the opening and closing of the contacts.

5 Claims, 5 Drawing Figures

ELECTRICAL CONNECTOR

BACKGROUND OF THE INVENTION

This invention relates generally to an electrical connector for printed circuit boards, and more particularly to an electrical connector wherein a low or zero insertion force is applied to the circuit board when the circuit board is inserted into the connector.

Low insertion force or zero force connectors are well known and come in a variety of configurations. Many electrical circuits are printed, or otherwise formed on either or both surfaces of an insulating substrate. The boards or substrates are inserted into receptacles which are then interconnected into other circuit devices to form complex electronic devices. The board has a plurality of conductive pads or strips on the marginal portions thereof which make contact to a "chip" or circuit in the center portion thereof.

The connector includes contacts for engaging the strips of conductive material on the board and making electrical connection with external circuit. The external circuit may be in the form of a board having a plurality of openings therein with each opening coated with an electrically conductive material. To complete the electrical connection with the printed boards, the board is inserted edgewise into a receiving zone to mechanically and electrically engage the contact points.

Since it is necessary to have many contact points for engaging the multiple strips on the board, the force required to insert the board into the receptacles can be high even though the individual force exerted by one contact is low.

Also, insertion of a board into the connector tends to wear away the terminal strips on the board and deteriorate the contacts. This may be detrimental to both the electrical and mechanical integrity of the system and this tends to reduce the useful life of the connector and the board. Thus, reduction of the force applied by the individual contacts against the circuit board permits the use of a greater number of contacts for a given insertion force.

An example of one type of known low insertion force connector can be found in U.S. Pat. No. 3,899,234 to Yeager et al. An elongated contact drive member is positioned at the bottom of an aperture and the cam is arranged to move therein. The connector is arranged for cam movement to drive the contacts into engagement with the board or drive the cams into and out of engagement position.

U.S. Pat. No. 3,478,301 to Conrad et al. utilizes a system where insertion of a printed circuit board into the receptacle actuates cam members to displace the contact members to electrical engagement with the circuit board. U.S. Pat. No. 4,021,091 to Anhalt et al. describes a connector having a hollow shell mounted over the contacts which is vertically movable within a housing. An elongated cam rod inside the outer housing is longitudinally movable to shift the shell downwardly to cam actuate the contacts.

U.S. Pat. No. 3,997,231 to Sherwood describes a connector having a camming device comprising a matched pair of blocks which urge the contacts into a circuit board engaging position when they are moved upwardly.

U.S. Pat. No. 4,179,177 to Lapraik relates to a connector or inner housing having upright sections which urge board portions of contacts apart as a cam is actuated.

U.S. Pat. No. 4,303,294 to Hamsher, Jr. et al. relates to connector having a cam which actuates an upright section to provide deflection of a compound beam contact. The contacts exert a force on the upright section to return it to a lower position. Other and further objects of the present invention will become apparent from the following description.

In accordance with the present invention, there is provided a zero or low insertion force connector for making electrical connection between a circuit board and an external circuit comprising an elongated outer housing having a channel extending in the longitudinal direction, a plurality of contacts mounted on said outer housing on either side of said channel, said contacts having lower end portions projecting exteriorly of said outer housing through the bottom of said channel, and upper portions interior said outer housing adapted to contact opposite sides of a circuit board, an inner housing mounted interior said outer housing for movement inwardly and outwardly along a vertical direction normal to the longitudinal direction, an ovally shaped cam having an axis of rotation extending in the longitudinal direction, said cam being adapted to be rotated from a first position presenting a narrow cross section in the vertical direction to a second position presenting a wider cross section in the vertical direction, a pair of first cam engaging surfaces and a pair of second cam engaging surfaces, said inner and outer housings each including respective first and second cam engaging surfaces, said first surfaces being diametrically opposed along the vertical direction and adapted to be moved apart when said cam is rotated from said first position, said second surfaces being laterally displaced from said first surfaces along the direction of rotation of said cam and adapted to be moved apart when said cam is rotated from said second position, said inner housing including means adapted to engage and urge upper portions of said contacts apart when said cam is rotated from one of said positions to the other of said positions whereby removal or insertion of a circuit board is permitted.

DETAILED DESCRIPTION OF THE INVENTION

Figure 1:
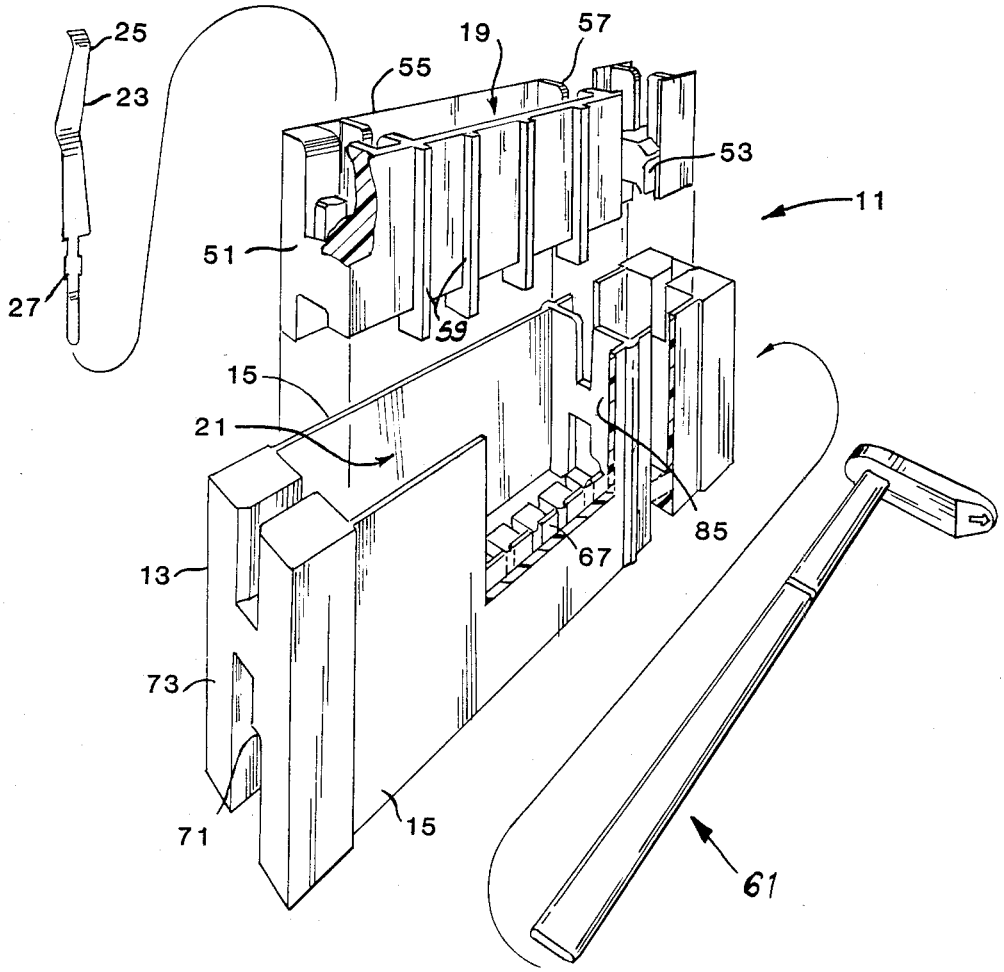
FIG. 1 is a perspective, exploded view of a connector with portions of the connector body broken away and shown in section.

As shown in FIG. 1, a connector 11 is provided for making electrical contact between a circuit board and an external circuit neither of which are shown. The circuit board generally is a conventional type integrated board having a circuit chip located in the center portion on one side of a planar substrate. Leads which provide for electrical connection radiate from the chip and terminate at the edges of the substrate. Various substrates having different configurations may be utilized with the connector of the present invention.

The connector 11 generally includes an outer housing 13 having two longitudinal and substantially parallel first sidewalls 15. The first sidewalls 15 form a channel 21 extending in the longitudinal direction. The housing 13 may be open at one or both ends so that a circuit board may be inserted through or into the end openings as well as into the top.

A plurality of contacts 23 are mounted in the outer housing 13 on either side of channel 21. The end portions 25 of the contacts 23 positioned generally interiorly of channel 21 are bowed inwardly for contacting a circuit board. Opposite end portions 27 have a retaining portion and a tail portion projecting exteriorily of the housing 13 through the bottom surface thereof. The tail portions may be conveniently plugged into a mother board or even wire wrapped. The retaining portions may be frictionally fitted into through bores in the housing 13 for retaining the contacts 23 in the proper position. As illustrated in the drawing, the contacts 23 are arranged in two parallel spaced apart rows with the end portions 25 of opposing rows facing each other and projecting inwardly for making electrical contact with a circuit board.

The contacts 23 can be made of any suitable material, selected for its spring-like and electrically conducive properties. Suitable materials are copper alloys. The contacts 23 which normally have the portions 25 projecting inwardly for engaging a circuit board are sufficiently resilient so they can be driven outwardly. An inner housing 51, which is positioned in the interior of the channel 21, has a pair of second sidewalls 55 forming an opening 19. Together the housings 13 and 51 form a zone for receiving a circuit board. The ends of the inner housing 51 are opened to permit insertion of the circuit board therethrough. Partitions 57, which extend widthwise across opening 19 on either side of the circuit board receiving zone are connected to an upright 53. The partitions 57 act as spacers to prevent short circuiting of the contacts 23 by forming recesses with the sidewalls 55. Each of the rows of contacts 23 is intermediate the upright 53 and one of the respective sidewalls 55.

The inner housing 51 is mounted within the channel 21 of outer housing 13 for movement up and down in a vertical direction normal to the longitudinal direction previously referred to. The inner housing 51 includes a plurality of outwardly facing ribs 59 which are vertically aligned and engage the interior surfaces of first sidewalls 15 of the outer housing 13. The ribs 59 reduce the friction between the inner 51 and outer 13 housings which might restrict movement.

An elongated cam 61 is disposed in the channel 21 and engages the inner housing 51 and outer housing 13 to move the inner housing 51 from a first to a second position with respect to the outer housing 13 when the cam 61 is actuated. The ovally shaped cam 61 has an axis of rotation extending in the longitudinal direction which results in narrower and wider cross sections being presented in the vertical direction as the cam 61 is rotated from one position to the other.

Figure 3:
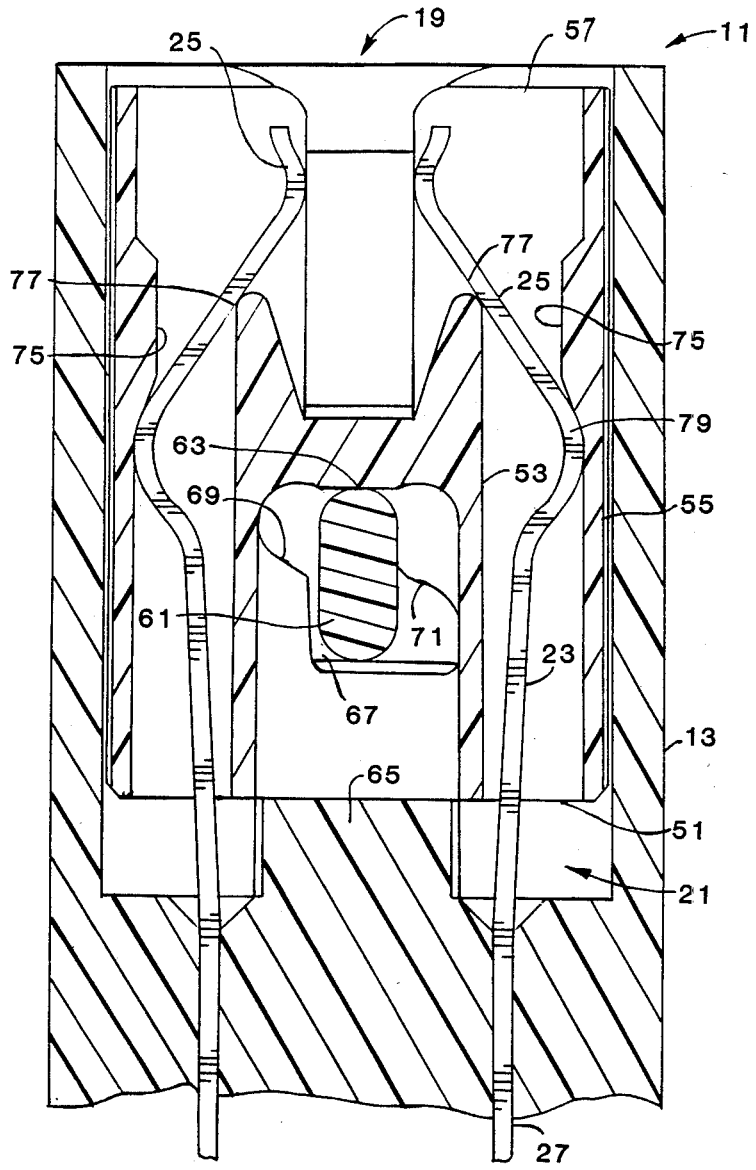
FIG. 3 is a cross-sectional view showing the connector of FIG. 2 in a receiving position.

The inner housing 51 and outer housing 13 each include a respective means for engaging the cam 61. As shown in FIG. 3, the upright 53 of the inner housing 51 includes a surface 63 which is spaced from the axis of rotation of the cam 61 along a vertical plane passing through the axis. A portion of the surface 63 which is generally normal to the aforementioned vertical plane engages the cam 61.

Diametrically opposed to surface 63, a complementary surface 67 is positioned. Surface 67 is formed on upstanding member 65 which is a fixed part of the outer housing 13 and provides a means for engaging cam 61. Surfaces 63 and 67 move apart when the cam 61 is rotated from a narrower to a wider cross section causing the inner housing 51 to move upwardly away from the bottom of inner housing 13.

As shown in FIG. 3, surface 69, which is laterally displaced from the surface 63 along the direction of rotation of the cam 61, is engaged and moves when the cam 61 is rotated from a wider to a narrower cross section with respect to the vertical axis. The surface 69 is formed as a part of the inner housing 51. Although surface 69 is shown as part of the partition 57, it may be formed as part of the upright section 53. As part of the cam engaging means for the outer housing 13, the outer housing 13 is provided with a surface 71 complementary to surface 69, which surfaces coact with the cam 61 to provide positive engagement. Surfaces 69 and 71 move apart when the cam 61 is rotated from a wider to a narrower position with respect to the vertical axis causing the inner housing 51 to move downwardly toward the inner housing 13. Although surface 71 is shown on an end wall 73 of the outer housing 13, it is contemplated that this surface 71 may be provided on the upstanding member 65 or on additional web 85 which interconnects the first sidewalls 15 as illustrated in FIG. 1.

Each of the second sidewalls 55 of the inner housing 51 include inwardly facing protrusions 75 adapted to engage contacts 23 in a respective row and urge the contacts 23 toward a circuit board when the inner housing 51 is moved to one of the positions described above. The contacts 23 are urged away from a circuit board when the inner housing 51 is moved to the other position by contact engaging portions 77 provided on the upright 53 of the inner housing 51.

Figure 2:
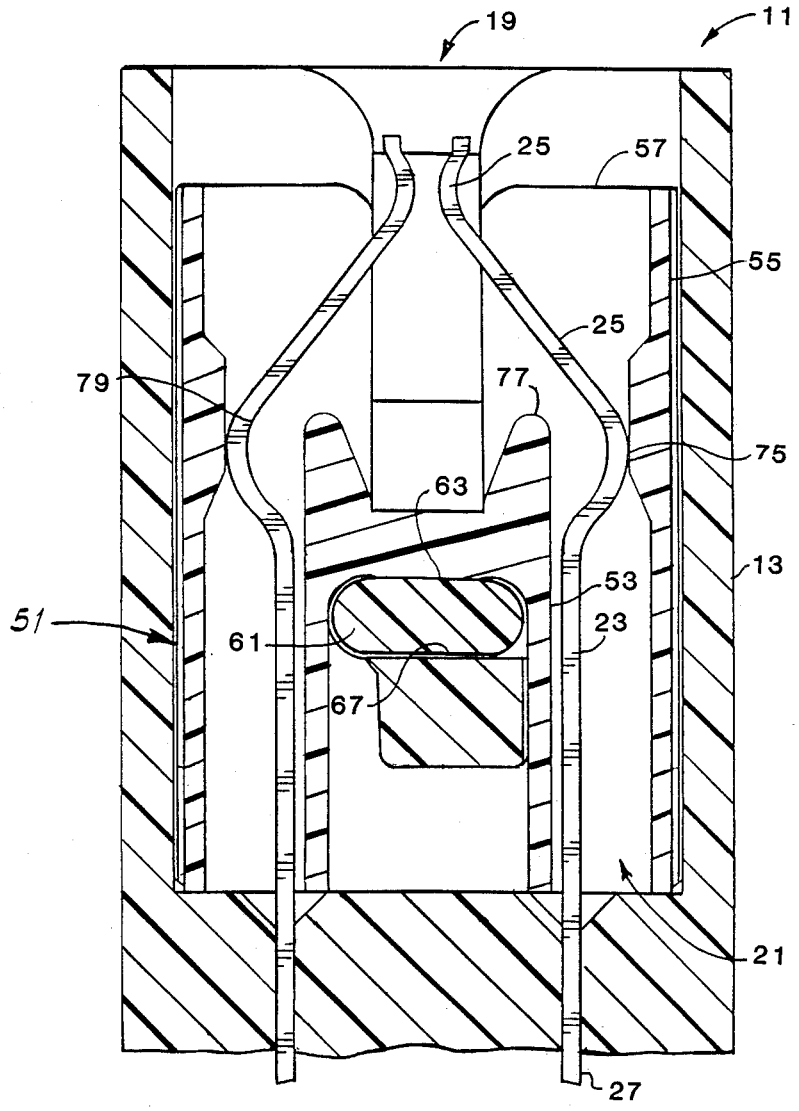
FIG. 2 is a cross-sectional view showing a connector in a closed position.
Figure 4:
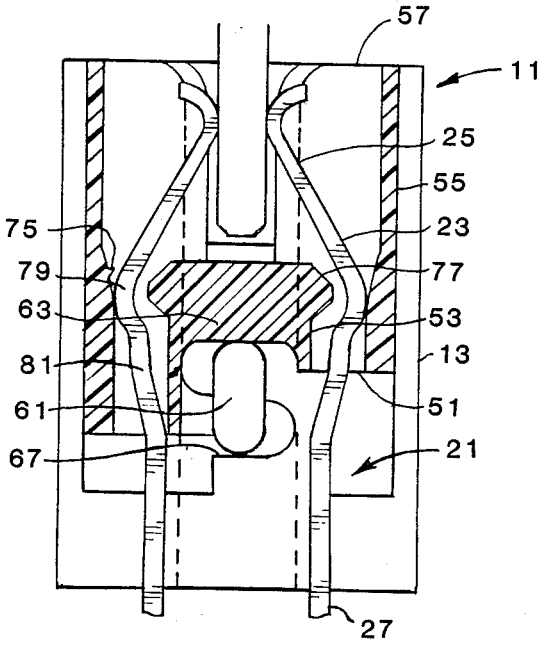
FIG. 4 is a cross-sectional view showing another embodiment in a closed position.
Figure 5:
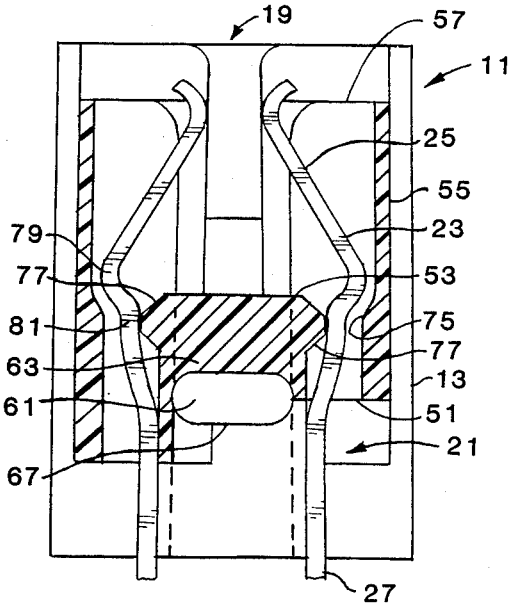
FIG. 5 is a cross-sectional view showing the connector of FIG. 4 in a receiving position.

The following is a discussion of the particular embodiments shown in FIG. 2 and FIG. 5. In FIG. 2, the inner housing 51 is in a lower position when the contacts 23 are closed and in an upper position when the contacts 23 are open. In FIG. 5, the opposite case is shown. In both cases, the contacts 23 include an outwardly bowed portion 79 intermediate end portions 25 and 27. The bowed portions 79 engage the protrusion 75 to urge the contacts 23 inwardly. The contacts 23 taper downwardly in one direction and upwardly in the other direction from the bowed portions 79 to provide a restricted area between rows of contacts 23 both above and below the bow. In the embodiment illustrated in FIGS. 2 and 3, the upright 53 and associated contact engaging portions 77 engage the contacts in the restricted area above the bowed portion 79. The protrusions 75 engage the bowed portion 79 as the inner housing 51 is moved downwardly to close urge the contacts 23 against a circuit board. The out of engagement positioning of the protrusions 75 is thusly above the bowed portion 79. In the embodiment illustrated in FIG. 4 and 5, the upright 53 and associated contact engaging portions 77 engage the contacts in the restricted area below the bowed portion 79. The protrusions 75 on the second sidewalls 55 move to an out of engagement position below the bowed portion as shown in FIG. 4. In FIG. 5, the protrusions 75 move to an engagement position with the bowed portion 79 as the inner housing 51 moves downwardly.

FIG. 5 illustrates an embodiment wherein the contacts 23 are provided with a straight or vertically aligned section 81 intermediate the bowed portion 79 and the restricted area. As illustrated in FIG. 5, the straight section is provided intermediate the bowed portion 79 and the portion 27. It is also contemplated that such a straight section may be provided for the contacts of FIG. 2 intermediate the bowed portion 79 and the portion 25. This feature assures contact opening to the proper predetermined gap. As the gap is closed by actuation of the cam 61, the contacts 23 are urged against both sides of a printed circuit board in such a manner that the contact wipes the board to provide good electrical contact. The wiping action is an inward and upward action due to the configuration of the contact.

We claim:

1. A zero or low insertion force connector for making electrical connection between a circuit board and an external circuit comprising: an elongated outer housing having a channel extending in a longitudinal direction; a plurality of contacts mounted in said outer housing on either side of said channel, said contacts having lower end portions projecting exteriorly of said outer housing through the bottom of said channel and upper portions interior of said outer housing adapted to contact opposite sides of a circuit board; an inner housing mounted within said outer housing for movement upwardly and downwardly in a vertical direction normal to said longitudinal direction; and ovally shaped cam having an axis or rotation extending in said longitudinal direction, said cam being adapted to be rotated from a first position presenting a narrow cross-section in the vertical direction to a second position presenting a wider cross-section in the vertical direction; a pair of first cam engaging surfaces and a pair of second cam engaging surfaces; said inner and outer housing each including a respective first and second cam engaging surface, said first cam engaging surfaces being diametrically opposed in said vertical direction and being adapted to be moved apart when said cam is rotated from said first position to said second position, said second surfaces being laterally displaced from said first surfaces along the direction of rotation of said cam and adapted to be moved apart when said cam is rotated from said second position to said first position, said inner housing including means adapted to engage and urge said upper portions of said contacts apart when said cam is rotated from one of said positions, whereby removal or insertion of a circuit board is permitted.

2. A zero or low insertion force connector according to claim 1 wherein said outer housing includes first sidewalls and an upstanding member positioned intermediate said first sidewalls, said upstanding member including one of said first surfaces.

3. A zero or low insertion force connector according to claim 2 wherein said inner housing includes second sidewalls and an upright positioned intermediate said second sidewalls, said upright including the other of said first surfaces.

4. A zero or low insertion force connector according to claim 3 wherein said inner housing includes a partition interconnecting said second sidewalls, said partition including one of said second surfaces.

5. A zero or low insertion force connector according to claim 4 wherein said outer housing includes a web interconnecting said first sidewalls, said web including the other of said second surfaces.

* * * * *